US009734686B2

(12) United States Patent
Grenn et al.

(10) Patent No.: US 9,734,686 B2
(45) Date of Patent: Aug. 15, 2017

(54) SYSTEM AND METHOD FOR ENHANCING A PROXIMITY WARNING SOUND

(71) Applicants: 2236008 Ontario Inc., Waterloo (CA); BlackBerry Limited, Waterloo (CA)

(72) Inventors: John Patrick Grenn, Waterloo (CA); Mark William Harvey, Delta (CA); Phillip Alan Hetherington, Vancouver (CA)

(73) Assignees: BlackBerry Limited, Waterloo, Ontario (CA); 2236008 Ontario Inc., Waterloo, Ontario (CA)

( * ) Notice: Subject to any disclaimer, the term of this patent is extended or adjusted under 35 U.S.C. 154(b) by 66 days.

(21) Appl. No.: 14/935,057

(22) Filed: Nov. 6, 2015

(65) Prior Publication Data

US 2017/0132893 A1 May 11, 2017

(51) Int. Cl.

| | |
|---|---|
| ***G08B 21/00*** | (2006.01) |
| ***G08B 21/02*** | (2006.01) |
| ***G08B 3/10*** | (2006.01) |
| ***G08G 1/16*** | (2006.01) |

(52) U.S. Cl.

CPC ..... *G08B 21/02* (2013.01); *G08B 3/10* (2013.01); *G08G 1/168* (2013.01)

(58) Field of Classification Search

None

See application file for complete search history.

(56) References Cited

U.S. PATENT DOCUMENTS

| | | | | |
|---|---|---|---|---|
| 5,812,056 | A * | 9/1998 | Law | G08B 21/0202 340/539.15 |
| 6,741,706 | B1 * | 5/2004 | McGrath | H04S 3/004 381/22 |
| 7,106,180 | B1 | 9/2006 | Pompei | |
| 9,185,062 | B1 * | 11/2015 | Yang | H04L 51/046 |
| 2009/0043591 | A1 * | 2/2009 | Breebaart | H04S 3/004 704/500 |
| 2009/0154716 | A1 * | 6/2009 | Jorgensen | H04S 7/00 381/63 |

(Continued)

FOREIGN PATENT DOCUMENTS

| | | |
|---|---|---|
| JP | 2002040131 | 6/2002 |
| JP | 2008046862 | 2/2008 |
| WO | WO 99/53455 | 10/1999 |

OTHER PUBLICATIONS

Meesawat, Kittiphong et al., "An Investigation on the Transition From Early Refelctions to a Reverberation Tail in a Brir," Proceedings of the 2002 International Conference on Auditory Display, Kyoto, Japan, Jul. 2-5, 2002; 5 pages.

(Continued)

*Primary Examiner* — Kerri McNally
*Assistant Examiner* — Renee Dorsey
(74) *Attorney, Agent, or Firm* — Brinks Gilson & Lione

(57) ABSTRACT

A system and method for enhancing a proximity warning sound may determine an indicator of a distance between a first object and a second object. A proximity warning sound may be generated including a reverberation mimicking component responsive to the determined distance indicator; where a human listener perceives the reverberation mimicking component included in the audible proximity warning sound to be indicative of the determined distance indicator.

30 Claims, 4 Drawing Sheets

(56) References Cited

U.S. PATENT DOCUMENTS

| | | | | |
|---|---|---|---|---|
| 2010/0079267 | A1* | 4/2010 | Lin | B60R 1/00 340/435 |
| 2011/0316967 | A1* | 12/2011 | Etter | H04N 7/142 348/14.16 |
| 2012/0025964 | A1* | 2/2012 | Beggs | B60Q 1/2673 340/435 |
| 2013/0272527 | A1* | 10/2013 | Oomen | G10K 15/12 381/17 |
| 2014/0112483 | A1* | 4/2014 | Etter | H03G 3/3005 381/56 |
| 2014/0119551 | A1* | 5/2014 | Bharitkar | H04H 60/33 381/59 |
| 2014/0150556 | A1* | 6/2014 | Angelsen | G01S 7/52095 73/627 |
| 2015/0070129 | A1* | 3/2015 | Moore | G09B 21/003 340/4.12 |

OTHER PUBLICATIONS

European Search Report corresponding to EP Application No. 16197407.6 dated Feb. 16, 2017, 8 pages.

* cited by examiner

SYSTEM AND METHOD FOR ENHANCING A PROXIMITY WARNING SOUND

BACKGROUND

1. Technical Field

The present disclosure relates to the field of processing audio signals. In particular, to a system and method for enhancing a proximity warning sound.

2. Related Art

Proximity warning systems may indicate the relative proximity between a first object and a second object. In some applications, objects may move relative to a person without the person's awareness. In some cases this may pose a safety hazard to either the person, the object, which may also be a person, or to the person's property. In other applications there may be a benefit in a person knowing the distance between themselves and the other person or object. Many automobiles contain proximity warning systems, or parking assistance systems that help the driver to avoid collisions with nearby objects and that include the use of audible feedback. The audible feedback is typically not in an intuitive form and therefore requires familiarization and learning on the part of the driver. The familiarization and learning requirement may cause some degree of distraction from the task at hand for the driver.

There is a need for an enhanced proximity warning systems that provides an audible queue and/or feedback related to a distance between a first object and a second object in an intuitive and safe manner.

BRIEF DESCRIPTION OF DRAWINGS

The system and method may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

Other systems, methods, features and advantages will be, or will become, apparent to one with skill in the art upon examination of the following figures and detailed description. It is intended that all such additional systems, methods, features and advantages be included with this description and be protected by the following claims.

DETAILED DESCRIPTION

A system and method for enhancing a proximity warning sound may determine an indicator of a distance between a first object and a second object. A proximity warning sound may be generated including a reverberation mimicking component responsive to the determined distance indicator; where a human listener perceives the reverberation mimicking component included in the audible proximity warning sound to be indicative of the determined distance indicator.

Figure 1A:
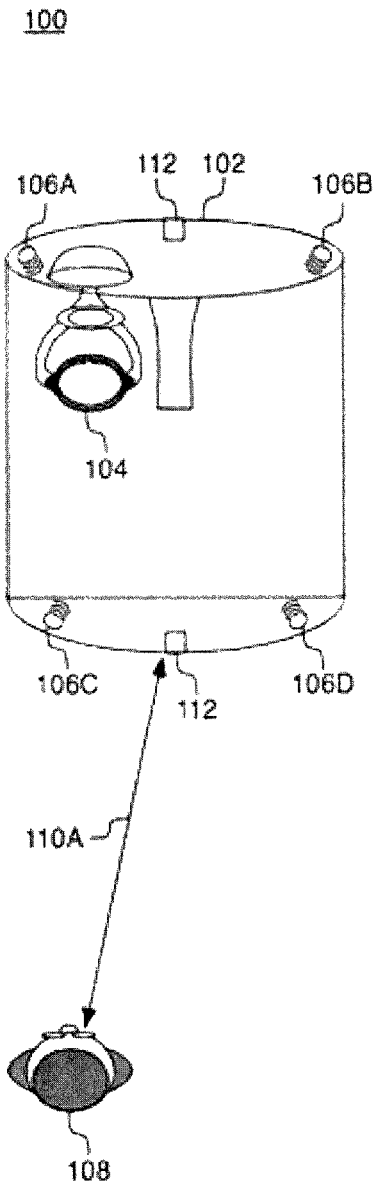
FIG. 1A is a schematic representation of an overhead view of an automobile in which a system for enhancing a proximity warning sound may be used.

FIG. 1A is a schematic representation of an overhead view of an automobile in which a system for enhancing a proximity warning sound 100 may be used. In both FIGS. 1A and 1B the representation of a automobile cabin may stand as a simplified representation of the automobile as a whole except where the description explicitly refers to the cabin. The example automobile, or first object 102, may include multiple audio transducers (a.k.a. audio speakers) 106A, 106B, 106C and 106D (collectively or generically audio transducers 106) and may be occupied and/or operated by a driver, or user 104. A person, or second object 108, may be located a distance 110A relative to the automobile. Either of the first object 102 and the second object 108 may be a stationary object or a moving object. One or more of the audio transducers 106 may emit a proximity warning sound generated by a proximity warning system. The proximity warning system may contain a distance estimator that may determine an indicator of the distance 110A between the automobile, or first object 102, and the person, or second object 108. The distance estimator associated with an automobile may utilize one or more external sensors 112 that may detect objects. External sensors 112 may include, for example, ultrasound, magnetic sensing, radio detection and ranging (RADAR), light detection and ranging (LIDAR), optical and infrared. One or more of the audio transducers 106 may emit a proximity warning sound generated by the proximity warning system responsive to the determined distance indicator.

Figure 1B:
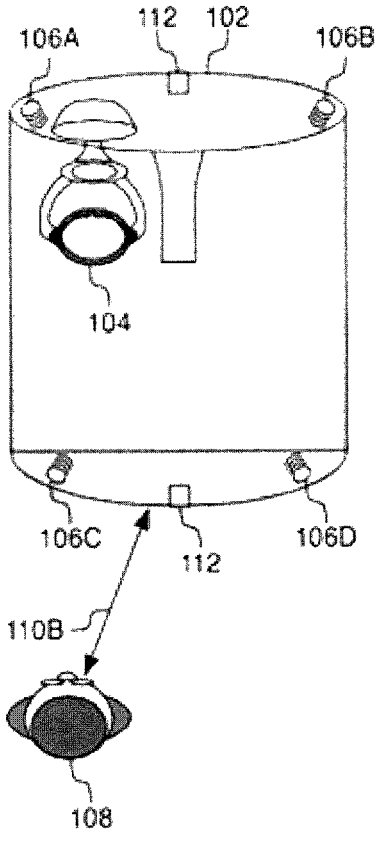
FIG. 1B is a schematic representation of an overhead view of an automobile in which a system for enhancing a proximity warning sound may be used.

FIG. 1B is a schematic representation of an overhead view of an automobile in which the system for enhancing a proximity warning sound 100 may be used in which the automobile, or first object 102, may have moved closer to the person, or second object 108, shown in FIG. 1A and may now be located a distance 110B relative to the automobile. The distance 110A and the distance 110B may be collectively or generically referred to as the distance 110. One or more of the audio transducers 106 may emit a proximity warning sound generated by the proximity warning system responsive to the determined distance indicator. The proximity warning sound emitted by the audio transducers 106 shown in FIG. 1B may be different than the proximity warning sound emitted by the audio transducers 106 shown in FIG. 1A indicating that the second object 108 is in closer proximity to the first object 102 and thereby that distance 110B is less than distance 110A. The proximity warning sound may utilize properties of sound to indicate proximity or the severity of a situation. The pitch, amplitude and/or repetition rate of the proximity warning sound may be modified to indicate proximity. For example, when reversing the automobile shown in FIG. 1A and FIG. 1B, the proximity warning system may increase the repetition rate or pitch of the proximity warning sound to indicate the proximity from the rear of the automobile 102 to the second object 108. In this description and the claims that follow references to indications of proximity may be understood to include estimations or approximations of either absolute or relative proximity. Where proximity may be understood to be a measure of distance between a first and a second object or point of reference. Further any reference to a measure of distance is not limited to a single linear measure of distance but may include measures of distance in multiple dimensions.

The proximity warning sound generated in FIG. 1A and FIG. 1B may in addition optionally indicate perceptually the orientation and/or position of the second object 108 relative to the position of the automobile 102. An orientation indicator may be determined for the orientation of the second object 108 relative to the automobile 102 using, for example, the one or more external sensors 112. Orientation of the second object relative to the first object may also be known as a direction or bearing. For example, the proximity warning sound may be spatialized using the audio transducers 106 so that the driver perceives the proximity warning sound to be emanating from behind and to the left of the driver. Spatializing the proximity warning sound may further inform the driver that the object is, for example, behind and to the left of the automobile. Proximity warning systems in an automobile may include, for example, parking and reversing assistance systems, pedestrian and object detection systems, blind-spot warning system, and lane departure warning systems. Further examples of proximity sounds that may be generated by a system for enhancing a proximity warning include a phone ringtone modified to indicate the distance to the location of a calling party.

A relative ratio of reverberations is a further property of sound that may be intrinsically linked to proximity and therefore potentially be more perceptually intuitive to a human listener than modifying the pitch, amplitude and/or the repetition rate of the proximity warning sound. The relative ratio of the reverberation tail components to the direct sound may be described as the wetness of the sound. When an object makes a sound in a room, the listener perceives the direct propagation of the sound and the indirect reflections of the sound that arrive later in time. The listener may perceive the sound associated with a close object to contain a direct, or dry, component that is louder than the indirect component. The listener may perceive the sound associated with a far away object to contain an indirect, or wet, component to be almost as loud as the direct components. The ratio of wet to dry components contained in a proximity warning sound may provide an intuitive indication of proximity to an object when generating a proximity warning sound.

A proximity warning system may generate a proximity warning sound including a reverberation mimicking component, or reverberation component. The gain or the tail length of a reverberation component may be used to indicate or suggest proximity to an object. In a first example, multiple proximity warning sounds may be stored a priori, each containing differing levels of reverberation where the wetter versions may be emitted by the system when far from an object and the dryer ones may be emitted when close to an object. In a second example, a proximity warning sound may be stored and then processed using a reverberation filter or convolution with an impulse response of a reverberant acoustic space based on the distance 110. The impulse response of the reverberant acoustic space may be dynamically created using, for example, inputs from external sensors 112 that detect objects. The reverberation components may be emitted from one or more of the audio transducers 106.

The proximity warning sound may include the reverberation component in addition to modified sound properties including, for example, pitch, amplitude and repetition rate. Utilizing the reverberation components to indicate proximity may add a useful dimension to help indicate proximity to an object in an intuitive manner and without jarring, frightening, or otherwise be distracting to a user. Further the inclusion of reverberation components in the proximity warning sound may allow the user (a.k.a. listener) to intuitively perceive a sense of indicated distance to an object (e.g. second object 108) while mitigating the need for familiarization or learning on the part of the user.

Figure 2:
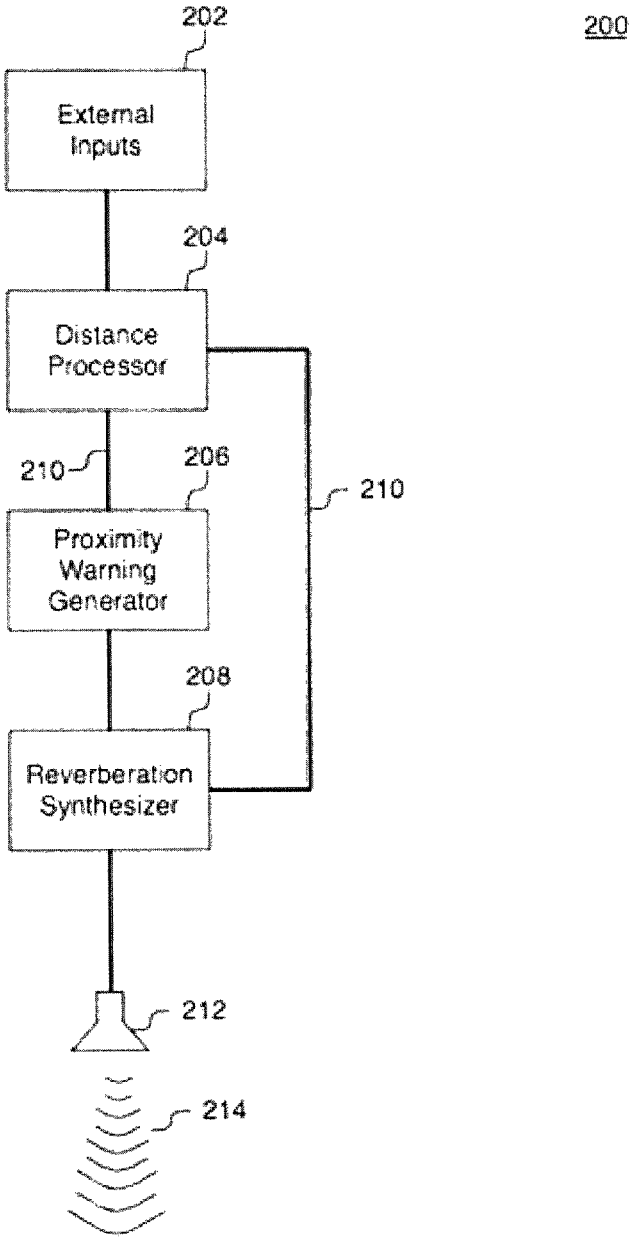
FIG. 2 is a schematic representation of a system for enhancing a proximity warning sound.

FIG. 2 is a schematic representation of a system for enhancing a proximity warning sound. The system 200 is an example system for enhancing a proximity warning sound. The example system configuration includes one or more external inputs 202, a distance processor 204, a proximity warning generator 206, a reverberation synthesizer 208 and one or more audio transducers 212. The one or more external inputs 202 may include data and/or signals that are responsive to the distance between a first object 102 and a second object 108. The distance processor 204 may utilize the one or more external inputs 202 to generate an indicator of a distance 210 between the first object 102 and the second object 108. The indicator of distance 210 may include an estimation or approximation of either absolute or relative distance between the first object 102 and the second object 108. The distance processor 204 may, for example, combine inputs from two or more external sensors 202 and/or smooth the inputs from the external sensors 202. The determined distance of either absolute or relative distance between the first object 102 and the second object 108 may change over time (i.e. the objects are in relative motion).

The proximity warning generator 206 may receive the indicator of determined distance 210 and generate or select a proximity warning sound to be emitted from the one or more audio transducers 212. The reverberation synthesizer 208 may receive the indicator of determined distance 210 and apply reverberation components to the proximity warning sound created by the proximity warning generator 206. In an alternative implementation, the proximity warning generator 206 may receive the indicator of determined distance 210 and responsive to the received indicator of determined distance 210 selects a proximity warning sound that contains reverberation mimicking components where a human listener perceives the reverberation mimicking components included in the audible proximity warning sound to be indicative of the indicator of determined distance 210. The proximity warning generator 206 may comprise an audio signal processor, a digital signal processor or other similar device for generating or modifying an audio signal. The one or more audio transducers 212 emit the proximity warning sound into an acoustic space 214.

Figure 3:
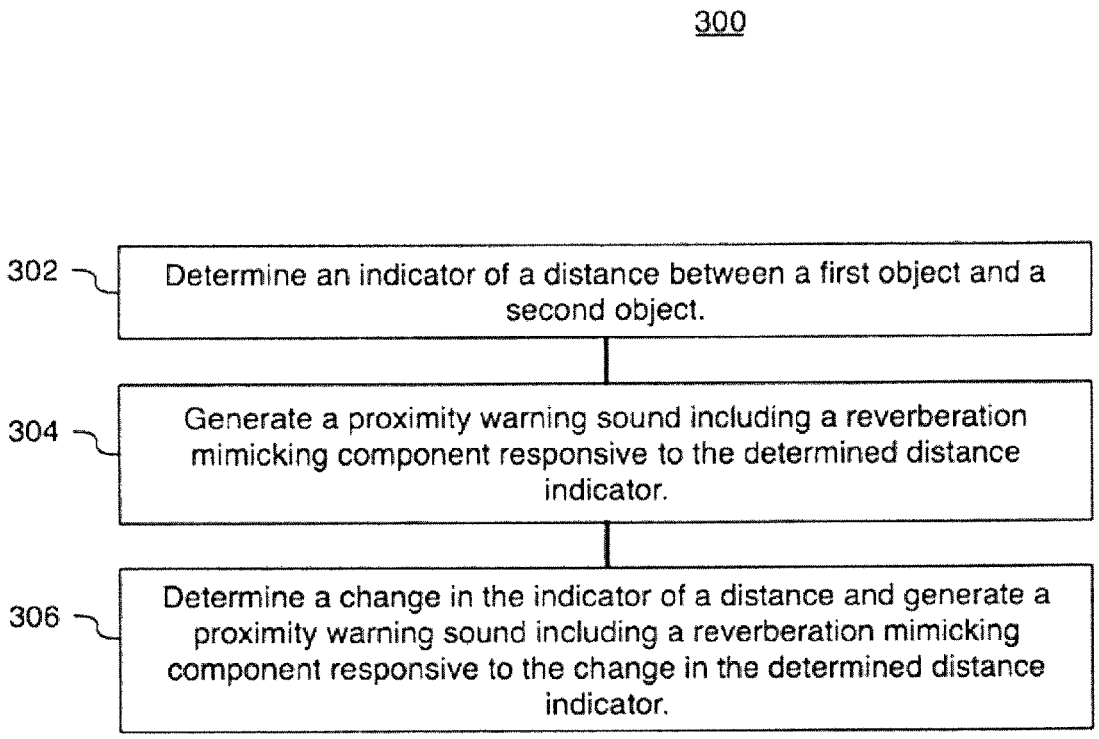
FIG. 3 is a representation of a method for enhancing a proximity warning sound.

FIG. 3 is a representation of a method for enhancing a proximity warning sound. The method 300 may be, for example, implemented using any of the systems 100 and 200 described herein with reference to FIGS. 1A, 1B, and 2. The method 300 may include the following acts. Determining an indicator of a distance between a first object and a second object 302. Generating a proximity warning sound including a reverberation mimicking component responsive to the determined distance indicator; where a human listener perceives the reverberation mimicking component included in the audible proximity warning sound to be indicative of the determined distance indicator 304. When the determined distance changes over time, the proximity warning sound including a reverberation mimicking component may be modified to reflect the change in determined distance.

Figure 4:
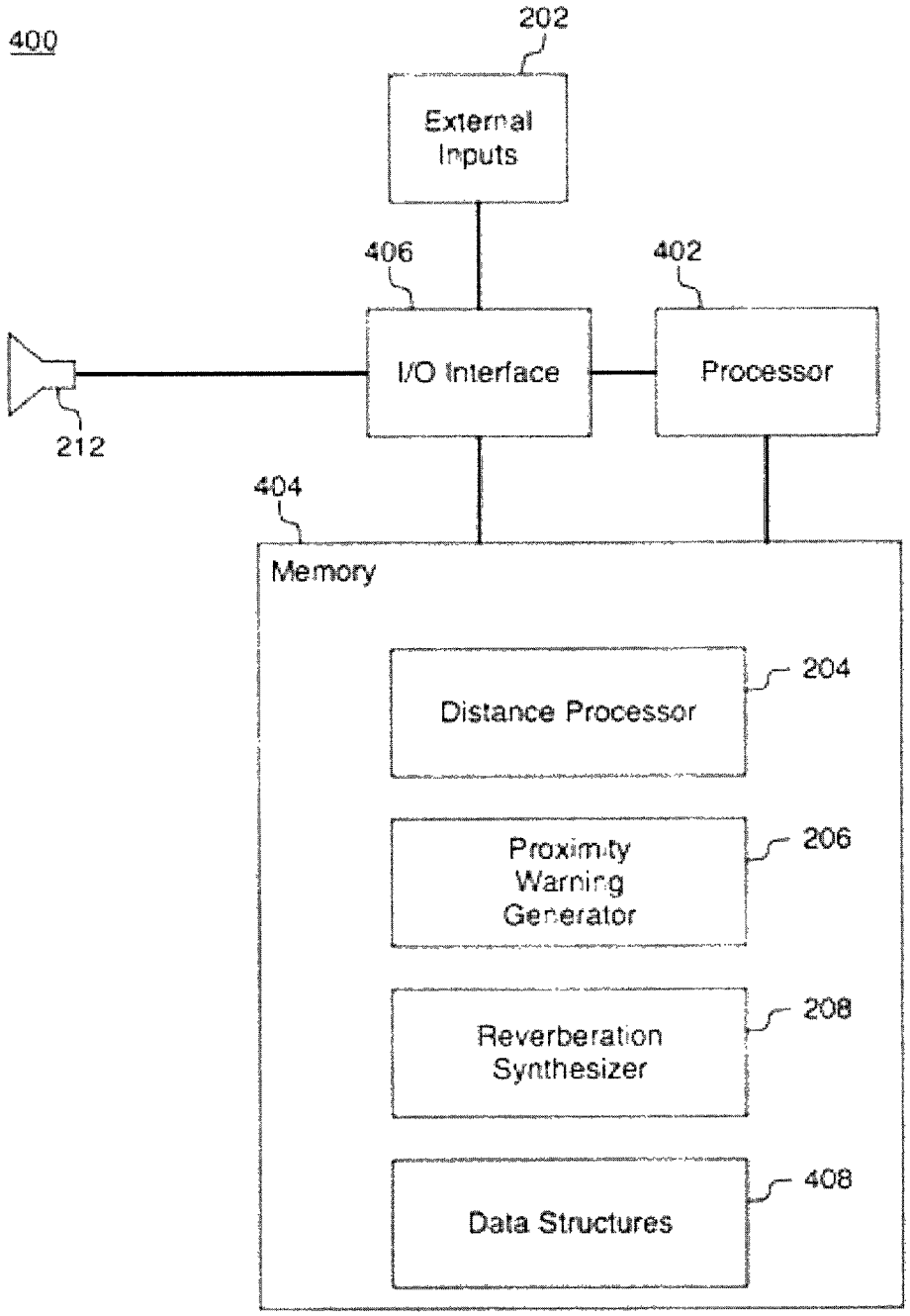
FIG. 4 is a further schematic representation of a system for enhancing a proximity warning sound.

FIG. 4 is a further schematic representation of a system for enhancing a proximity warning sound. The system 400 comprises a processor 402, memory 404 (the contents of which are accessible by the processor 402) and an I/O interface 406. The memory 404 may store instructions which when executed using the process 402 may cause the system 400 to render the functionality associated with enhancing a proximity warning sound as described herein. For example, the memory 804 may store instructions which when executed using the processor 402 may cause the system 400 to render the functionality associated with the distance processor 204, the proximity warning generator 206 and the reverberation synthesizer 208 as described herein. In addition, data structures, temporary variables and other information may store data in data storage 408.

The processor 402 may comprise a single processor or multiple processors that may be disposed on a single chip, on multiple devices or distributed over more that one system. The processor 402 may be hardware that executes computer executable instructions or computer code embodied in the memory 404 or in other memory to perform one or more features of the system. The processor 402 may include a general purpose processor, a central processing unit (CPU), a graphics processing unit (GPU), an application specific integrated circuit (ASIC), a digital signal processor (DSP), a field programmable gate array (FPGA), a digital circuit, an analog circuit, a microcontroller, any other type of processor, or any combination thereof.

The memory 404 may comprise a device for storing and retrieving data, processor executable instructions, or any combination thereof. The memory 404 may include non-volatile and/or volatile memory, such as a random access memory (RAM), a read-only memory (ROM), an erasable programmable read-only memory (EPROM), or a flash memory. The memory 404 may comprise a single device or multiple devices that may be disposed on one or more dedicated memory devices or on a processor or other similar device. Alternatively or in addition, the memory 404 may include an optical, magnetic (hard-drive) or any other form of data storage device.

The memory 404 may store computer code, such as the distance processor 204, the proximity warning generator 206 and the reverberation synthesizer 208 as described herein. The computer code may include instructions executable with the processor 402. The computer code may be written in any computer language, such as C, C++, assembly language, channel program code, and/or any combination of computer languages. The memory 404 may store information in data structures including, for example, information representative of an impulse response or a reverberant acoustic space.

The I/O interface 406 may be used to connect devices such as, for example, the audio transducers 106 and 212, the external inputs 202 and to other components of the system 400.

All of the disclosure, regardless of the particular implementation described, is exemplary in nature, rather than limiting. The system 400 may include more, fewer, or different components than illustrated in FIG. 4. Furthermore, each one of the components of system 400 may include more, fewer, or different elements than is illustrated in FIG. 4. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a CPU.

While various embodiments of the system and method system and method for enhancing a proximity warning sound, it will be apparent to those of ordinary skill in the art that many more embodiments and implementations are possible within the scope of the present invention. Accordingly, the invention is not to be restricted except in light of the attached claims and their equivalents.

The invention claimed is:

1. A method for enhancing a proximity warning sound comprising:

determining an indicator of a distance between a first physical object and a second physical object by a processor; and generating a proximity warning sound, by an audio signal processor, including a reverberation mimicking component that includes reverberation tail components indicative of the proximity of the first physical object to the second physical object responsive to the determined distance indicator; where the reverberation mimicking component included in the proximity warning sound that is indicative of the determined distance indicator.

2. The method for enhancing a proximity warning sound of claim 1, where each of the first physical object and the second physical object includes an automobile.

3. The method for enhancing a proximity warning sound of claim 1, where the determining an indicator of the distance uses one or more external transceivers that detect the position of physical objects.

4. The method for enhancing a proximity warning sound of claim 1, where the indicator of the distance between the first physical object and the second physical object is updated responsive to changes in the distance over time and the step of generating the proximity warning sound is responsive to updates to the indicator of the distance between the first physical object and the second physical object.

5. The method for enhancing a proximity warning sound of claim 1, where the reverberation mimicking component modifies a relative ratio of the reverberation tail components to a direct sound responsive to the determined distance indicator.

6. The method for enhancing a proximity warning sound of claim 5, where the relative ratio of the reverberation tail components to the direct sound is decreased responsive to a decreasing determined distance indicator.

7. The method of enhancing a proximity warning sound of claim 6, where the reverberation tail components includes any one or more of:

reverberation gain, impulse response of a reverberant acoustic space and the reverberation tail length.

8. The method for enhancing a proximity warning sound of claim 6, where the reverberation mimicking component modifies the relative ratio of the reverberation tail components to the direct sound by selecting one of one or more proximity warning sounds containing differing ratios of reverberation tail components to direct sound that are generated a priori.

9. The method for enhancing a proximity warning sound of claim 1, further comprising: determining an orientation indicator of an orientation of the second physical object relative to the first physical object; where the proximity warning sound is spatialized responsive to the determined orientation indicator when played through audio transducers.

10. The method for enhancing a proximity warning sound of claim 1, where the determined indicator of distance is an estimate of a relative proximity of the second physical object to the first physical object.

11. A system for enhancing a proximity warning sound comprising:

a determiner for determining an indicator of a distance between a first physical object and a physical second object; and a generator for generating a proximity warning sound including a reverberation mimicking component that includes reverberation tail components indicative of the proximity of the first physical object to the second physical object responsive to the determined distance indicator; the reverberation mimicking component included in the proximity warning sound that is indicative of the determined distance indicator.

12. The system for enhancing a proximity warning sound of claim 11, where each of the first physical object and the second physical object includes an automobile.

13. The system for enhancing a proximity warning sound of claim 11, where determining an indicator of the distance uses one or more sensors that detect physical objects, and where the one or more sensors includes any one or more of: ultrasound, magnetic sensing, radio detection and ranging, light detection and ranging, optical and infrared.

14. The system for enhancing a proximity warning sound of claim 11, where the indicator of the distance between the first physical object and the second physical object is updated responsive to changes in the distance over time and the step of generating the proximity warning sound is responsive to updates to the indicator of the distance between the first physical object and the second physical object.

15. The system for enhancing a proximity warning sound of claim 11, where the reverberation mimicking component modifies a relative ratio of the reverberation tail components to the direct sound responsive to the determined distance indicator.

16. The system for enhancing a proximity warning sound of claim 15, where the relative ratio of the reverberation tail components to the direct sound is decreased responsive to a decreasing determined distance indicator.

17. The system for enhancing a proximity warning sound of claim 15, where the reverberation mimicking component modifies the relative ratio of the reverberation tail components to the direct sound by selecting one of one or more proximity warning sounds containing differing ratios of reverberation tail components to direct sound that are generated a priori.

18. The system for enhancing a proximity warning sound of claim 11, further comprising: determining an orientation indicator of an orientation of the second physical object relative to the first physical objection; where the proximity warning sound is spatialized responsive to the determined orientation indicator when played through audio transducers.

19. The system for enhancing a proximity warning sound of claim 11, where the proximity warning sound is associated with a proximity warning system.

20. The system for enhancing a proximity warning sound of claim 19, where the proximity warning system includes any one or more of: a parking assistance system, a reversing assistance systems, a pedestrian detection system, an object detection system, blind-spot warning system, and a lane departure warning system.

21. A non-transitory machine-readable medium encoded with machine-executable instructions, where execution of the machine-executable instructions is for:

determining an indicator of a distance between a first physical object and a second physical object by a processor; and generating a proximity warning sound, by an audio signal processor, including a reverberation mimicking component that includes reverberation tail components indicative of the proximity of the first physical object to the second physical object responsive to the determined distance indicator; where the reverberation mimicking component included in the proximity warning sound that is indicative of the determined distance indicator.

22. The non-transitory machine-readable medium of claim 21, where each of the first physical object and the second physical object includes an automobile.

23. The non-transitory machine-readable medium of claim 21, where the determining an indicator of the distance uses one or more external transceivers that detect the position of physical objects.

24. The non-transitory machine-readable medium of claim 21, where the indicator of the distance between the first physical object and the second physical object is updated responsive to changes in the distance over time and the step of generating the proximity warning sound is responsive to updates to the indicator of the distance between the first physical object and the second physical object.

25. The non-transitory machine-readable medium of claim 21, where the reverberation mimicking component modifies a relative ratio of the reverberation tail components to direct sound responsive to the determined distance indicator.

26. The non-transitory machine-readable medium of claim 25, where the relative ratio of the reverberation tail components to the direct sound is decreased responsive to a decreasing determined distance indicator.

27. The non-transitory machine-readable medium of claim 26, where the reverberation tail components includes any one or more of: reverberation gain, impulse response of a reverberant acoustic space and the reverberation tail length.

28. The non-transitory machine-readable medium of claim 26, where the reverberation mimicking component modifies the relative ratio of the reverberation tail components to the direct sound by selecting one of one or more proximity warning sounds containing differing ratios of reverberation tail components to direct sound that are generated a priori.

29. The non-transitory machine-readable medium of claim 21, further comprising non-transitory machine readable medium for determining an orientation indicator of an orientation of the second physical object relative to the first physical object; where the proximity warning sound is spatialized responsive to the determined orientation indicator when played through audio transducers.

30. The non-transitory machine-readable medium of claim 21, where the determined indicator of distance is an estimate of a relative proximity of the second physical object to the first physical object.

* * * * *